US011664618B2

(12) United States Patent
Wu et al.

(10) Patent No.: US 11,664,618 B2
(45) Date of Patent: May 30, 2023

(54) CONNECTOR TERMINAL

(71) Applicant: DONGGUAN LUXSHARE TECHNOLOGIES CO., LTD, Dongguan (CN)

(72) Inventors: Xiaoping Wu, Dongguan (CN); Rongzhe Guo, Dongguan (CN); Xiaogang Liu, Dongguan (CN); Bin Huang, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 41 days.

(21) Appl. No.: 17/459,711

(22) Filed: Aug. 27, 2021

(65) Prior Publication Data

US 2022/0384975 A1 Dec. 1, 2022

(30) Foreign Application Priority Data

May 31, 2021 (CN) ..... 202110600707.6

(51) Int. Cl.
*H01R 13/24* (2006.01)
*H01R 13/40* (2006.01)
*H01R 13/516* (2006.01)

(52) U.S. Cl.
CPC ..... *H01R 13/2407* (2013.01); *H01R 13/40* (2013.01); *H01R 13/516* (2013.01)

(58) Field of Classification Search
CPC .. H01R 13/2407; H01R 13/40; H01R 13/516; H01R 12/727; H01R 13/2442
See application file for complete search history.

(56) References Cited

U.S. PATENT DOCUMENTS

| | | | | |
|---|---|---|---|---|
| 6,676,449 | B2 * | 1/2004 | Ji | H01R 13/6582 439/79 |
| 9,742,132 | B1 * | 8/2017 | Hsueh | H01R 24/60 |
| 10,439,309 | B2 * | 10/2019 | Ju | H01R 13/115 |
| 11,296,445 | B2 * | 4/2022 | Shen | H01R 13/6599 |
| 2006/0035484 | A1 | 2/2006 | Hsu | |
| 2017/0194729 | A1 | 7/2017 | Cai | |

(Continued)

FOREIGN PATENT DOCUMENTS

| | | | |
|---|---|---|---|
| CN | 2299403 | Y | 12/1998 |
| CN | 201590512 | U | 9/2010 |
| CN | 203218501 | U | 9/2013 |

(Continued)

*Primary Examiner* — Travis S Chambers
(74) *Attorney, Agent, or Firm* — Birch, Stewart, Kolasch & Birch, LLP

(57) ABSTRACT

A connector terminal includes a terminal body. An elastic arm structure is arranged on one end of the terminal body, and includes a support part and a contact part. The support part is a bending structure formed by sequentially connecting multiple extension sections, a first end of the support part is an operation end and a second end of the support part is a connection end, from the connection end to the operation end, an included angle between a first direction and each of extension directions of the multiple extension sections is gradually reduced, and the first direction is parallel to a length direction of the terminal body. The contact part is arranged at the operation end and is bent towards an inner side of the bending structure.

9 Claims, 4 Drawing Sheets

(56) References Cited

U.S. PATENT DOCUMENTS

2021/0135389 A1* 5/2021 Jiang ..... H01R 13/6461

FOREIGN PATENT DOCUMENTS

| | | | |
|---|---|---|---|
| CN | 204030050 | U | 12/2014 |
| CN | 104901048 | A | 9/2015 |
| CN | 109861017 | A | 6/2019 |
| CN | 110875538 | A | 3/2020 |

* cited by examiner

CONNECTOR TERMINAL

CROSS-REFERENCE TO RELATED APPLICATION(S)

This application claims priority to Chinese Patent Application No. 202110600707.6 filed May 31, 2021, the disclosure of which is incorporated herein by reference in its entirety.

TECHNICAL FIELD

The present disclosure relates to the technical field of conductive terminals and electrical connectors and, in particular, to an elastic arm structure and a connector terminal.

BACKGROUND

With the increasingly obvious demand of electronic products, functions of the products are constantly expanding, and the internal structure and transmission speed of the products also need to be continuously improved to improve the performance of products. For the terminal structure used for data transmission and signal detection of the connector, the elastic arm on the terminal structure is easy to rub with other electronic components during the insertion and extraction process of the products. However, in the related art, the structure shape and size setting of the elastic arm on the terminal structures are different according to different adapted products, but the phenomenon that the elastic arm is damaged due to abrasion during the insertion and extraction process always occurs, affecting the normal use of the products.

SUMMARY

The present disclosure provides an elastic arm structure and a connector terminal, so that the elastic arm structure cannot be easily damaged during the insertion and extraction process, and the normal use of the connector terminal in the connector is ensured.

The technical solution described below is provided.

An elastic arm structure, is configured to be arranged at one end of a terminal body, and includes a support part and a contact part.

The support part is a bending structure formed by sequentially connecting multiple extension sections, a first end of the support part is an operation end, a second end of the support part is a connection end, and from the connection end to the operation end, an included angle between a first direction and each of extension directions of the multiple extension sections is gradually reduced, and the first direction is parallel to a length direction of the terminal body.

The contact part is arranged at the operation end and is bent towards an inner side of the bending structure.

A connector terminal includes an insulation body and multiple terminal bodies, where each of the multiple terminal bodies includes any elastic arm structure described above, the elastic arm structure protrudes out of a first end of the insulation body, and the terminal body further includes: a base part and a fixing part.

The base part is arranged on the insulation body and extends along the first direction.

The fixing part is arranged on the insulation body, the fixing part includes a first fixing part and a second fixing part which are arranged at an included angle, the first fixing part extends in the first direction, a first end of the first fixing part extends out of the insulation body and is connected to the connection end, a second end of the first fixing part is connected to a first end of the second fixing part, a bending direction of the first fixing part with respect to the support part is opposite to a bending direction of the contact part with respect to the support part, a second end of the second fixing part is connected to a first end of the base part, and a bending direction of the second fixing part with respect to the first fixing part is opposite to a bending direction of the support part with respect to the first fixing part.

BRIEF DESCRIPTION OF DRAWINGS

The accompanying drawings used in description of the embodiments will be described below. Apparently, the accompanying drawings described below illustrate part of embodiments of the present disclosure, and those skilled in the art may obtain other drawings on the basis of the contents and the accompanying drawings described below on the premise that no creative work is done.

REFERENCE LIST

Figure 1:
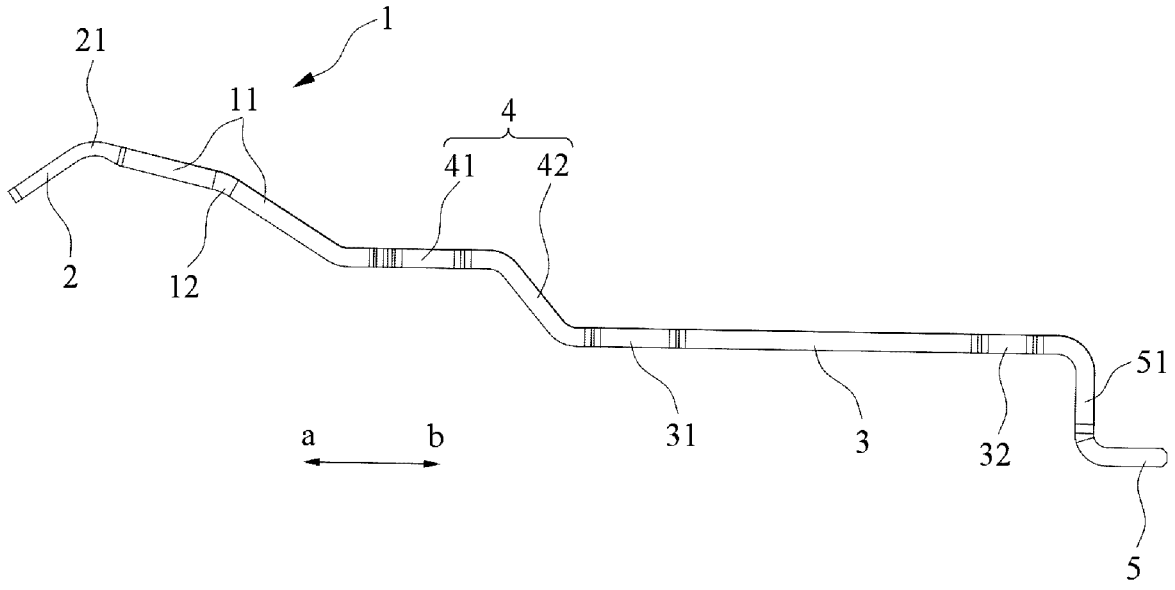
FIG. 1 is a structural diagram of an elastic arm structure provided by embodiment one of the present disclosure.

100—insulation body;

201—first terminal body; 202—second terminal body; 203—third terminal body;

1—support part; 11—extension section; 111—through hole; 112—first side; 113—second side; 114—third side; 115—fourth side; 12—second arc-shaped section;

2—contact part; 21—first arc-shaped section;

3—base part; 31—first reinforcing part; 32—second reinforcing part;

4—fixing part; 41—first fixing part; 42—second fixing part; 421—fixing hole;

5—welding part; 51—connection part.

DETAILED DESCRIPTION

The solution of the present disclosure will be described below in conjunction with the accompanying drawings and the embodiment.

In the description of the present disclosure, it is to be noted that the orientational or positional relationships indicated by terms "above", "below", "left", "right", "vertical", "horizontal", "inside", "outside" and the like are based on the orientational or positional relationships illustrated in the drawings or the orientational or positional relationship in which products of the present disclosure are usually placed during use. These orientational or positional relationships are for the mere purpose of facilitating and simplifying the description of the present disclosure and do not indicate or imply that the apparatus or element referred to has a specific orientation and is constructed and operated in a specific orientation. In addition, terms such as "first" and "second" are used merely for the purpose of description, or are used for distinguish different structures or components, and are not to be construed as indicating or implying relative importance.

In the description of the present disclosure, it should be noted that unless otherwise expressly specified and limited, the term "mounting", "connected to each other" or "connected" is to be construed in a broad sense, for example, as securely connected or detachably connected; mechanically connected or electrically connected; directly connected to each other or indirectly connected to each other via an intermediary; or internally connected between two elements. For those of ordinary skill in the art, meanings of the preceding terms in the present disclosure may be construed based on situations.

The solutions of the present disclosure will be further described below through embodiments in conjunction with the drawings.

Embodiment One

Figure 2:
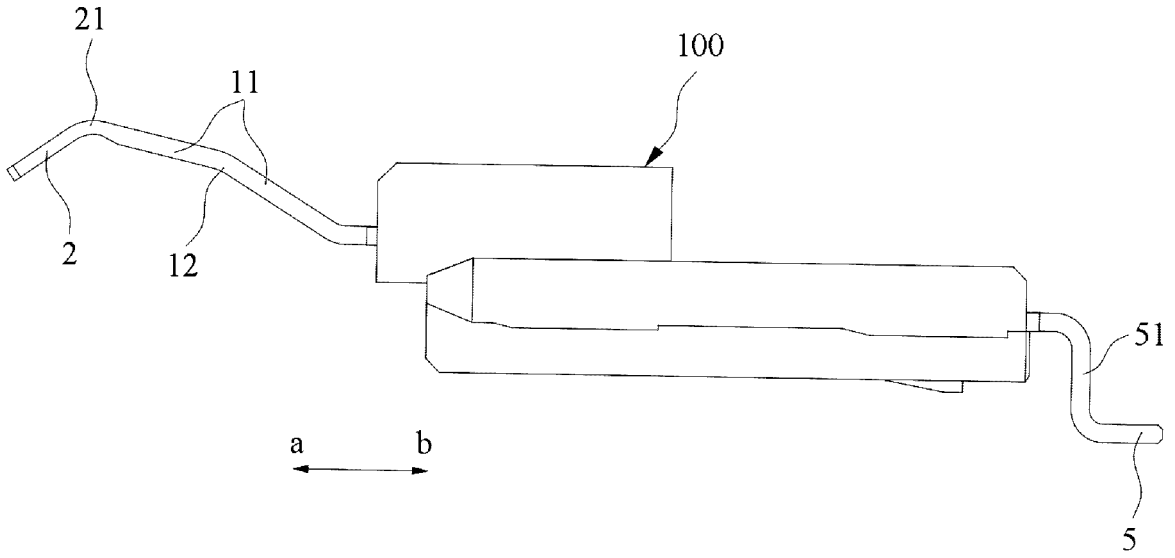
FIG. 2 is a structural diagram of a connector terminal provided by embodiment one of the present disclosure.

Referring to FIGS. 1 and 2, the present embodiment provides an elastic arm structure. The elastic arm structure is arranged at one end of a terminal body, includes a support part 1 and a contact part 2. The support part 1 is a bending structure formed by sequentially connecting two extension sections 11. A first end of the support part 1 is an operation end, and a second end of the first fixing part 1 is a connection end. From the connection end to the operation end, an included angle between a first direction and each of extension directions of the extension sections is gradually reduced, and the first direction is parallel to a length direction of the terminal body. The length direction of the terminal body is a direction shown by the arrow ab in FIG. 1. The contact part 2 is arranged at the operation end and is bent towards an inner side of the bending structure.

The elastic arm structure in this embodiment is arranged in the contact part 2 of the operation end of the support part 1 by the supporting of the support part 1. Optionally, the bending structure is formed by sequentially connecting two extension sections 11 and an included angle of each of the extension directions of the two extension sections 11 and the length direction of the terminal body is configured differently, that is, an included angle between one extension section 11 of the two extension sections 11 connected to the contact part 2 and the first direction is smaller than an included angle between the other extension section 11 of the two extension sections and the first direction, thereby reducing a drop between the operation end and the connection end on the support part 1, enhancing a support force to the contact part 2, so that the elastic arm structure cannot be easily damaged during the insertion and extraction process, and the normal use of the connector terminal in the connector is ensured.

Referring to FIG. 1, one end of the contact part 2 is bent to form a first arc-shaped section 21, the contact part 2 is connected to the operation end by the first arc-shaped section 21, and an inner side of the first arc-shaped section 21 is arranged towards the inner side of the bending structure. The support part 1 and the contact part 2 are transitionally connected by the first arc-shaped section 21, so that the stress concentration at the connection between the support part 1 and the contact part 2 can be avoided, the overall strength of the elastic arm structure can be improved, and the electrical contact between the contact part 2 and a chip module can be ensured.

Referring to FIG. 1, the two extension sections 11 are connected by a second arc-shaped section 12, the inner side of the second arc-shaped section 12 is arranged towards the inner side of the bending structure. The two extension sections 11 are transitionally connected by the second arc-shaped section 12, so that the occurrence of the stress concentration is avoided when the support part 1 is pressed by the chip module, and the strength of the support part 1 is improved.

Referring to FIG. 2, this embodiment also provides a connector terminal. The connector terminal includes an insulation body 100 and multiple terminal bodies. Multiple terminal bodies are arranged in parallel with each other on the insulation body 100. Referring to FIG. 1, each terminal body includes an elastic arm structure in the above embodiment, and the elastic arm structure extends out of a first end of the insulation body 100, and the terminal body further includes a base part 3 and a fixing part 4. The base part 3 is arranged on the insulation body 100 and extends in a first direction; and the first direction is parallel to a length direction of the terminal body. The length direction of the terminal body is a direction shown by the arrow ab in FIG. 1. The fixing part 4 is arranged on the insulation body 100, the fixing part 4 includes a first fixing part 41 and a second fixing part 42 which are arranged at an included angle, the first fixing part 41 extends in the first direction, a first end of the first fixing part 41 protrudes out of the insulation body 100 and is connected to the connection end, a second end of the first fixing part 41 is connected to a first end of the second fixing part 42, a bending direction of the first fixing part 41 with respect to the support part 1 is opposite to a bending direction of the contact part 2 with respect to the support part 1, a second end of the second fixing part 42 is connected to a first end of the base part 3, and a bending direction of the second fixing part 42 with respect to the first fixing part 41 is opposite to a bending direction of the support part 1 with respect to the first fixing part 41.

In the connector terminal in this embodiment, the terminal body is fixed to the insulation body 100 by the base part 3 and the fixing part 4. The fixing part 4 includes the first fixing part 41 and the second fixing part 42 arranged at an included angle. The first fixing part 41 is used for being fixing on the insulation body 100, a first end of the first fixing part 41 protrudes out of the insulation body 100 and is capable of carrying the support part 1. The first fixing part 41 and the base part 3 are transitionally connected by the second fixing part 42. The bending configuration among the base part 3, the first fixing part 41 and the second fixing part 42 enable the connector terminal structure to have good stress-strain characteristics, so as to achieve stable electrical connection when they are used in the connector.

Referring to FIG. 1, the first end of the base part 3 connected to the second fixing part 42 is provided with a first reinforcing part 31, and the second end of the second fixing part 42 connected to the base part 3 is provided with a third arc-shaped section. The first reinforcing part 31 is connected to the third arc-shaped section, and an inner side of the third arc-shaped section is arranged to be opposite to an inner side of a bending structure. The first reinforcing part 31 passes through a mounting hole in the insulation body 100 so that the first end of the base part 3 is fixed to the insulation body 100. The bending between the second fixing part 42 and the base part 3 is transited by the third arc-shaped section, so that the stress concentration at the connection of the second fixing part 42 and the first reinforcing part 31 can be avoided, and the overall strength of the terminal structure can be improved.

Referring to FIG. 1, the terminal body further includes a welding part 5 connected to the second end of the base part 3. The welding part 5 protrudes out of a second end of the insulation body 100 and is used for externally connecting to a circuit board of the connector.

Referring to FIG. 1, one end of the welding part 5 connected to the base part 3 is provided with a connection part 51, a bending direction of the connection part 51 with respect to the base part 3 is opposite to the bending direction of the second fixing part 42 with respect to the base part 3, and the bending direction of the connection part 51 with respect to the welding part 5 is opposite to a bending direction of the base part 3 with respect to the connection part 51. In the above configuration, the connection part 51 is located outside the insulation body 100, and the welding part 5 cooperates with the connection part 51 to form a shape which is convenient for the circuit board welding, thereby ensuring the signal stability of the electrical connection between the welding part 5 and the circuit board of the connector.

Referring to FIG. 1, the second end of the base part 3 connected to the connection part 51 is provided with a second reinforcing part 32 so that the first end of the base part 3 is fixed to the insulation body 100.

Optionally, the first fixing part 41 and the second fixing part 42 are connected by a fourth arc-shaped section. An inner side of the fourth arc-shaped section is arranged towards the inner side of the bending structure, and the arrangement of the fourth arc-shaped section can improve the stability and strength of the fixing part 4.

Embodiment Two

Referring to FIGS. 3 to 6, this embodiment provides a connector terminal. The difference between the connector terminal provided in the present embodiment and the connector terminal provided in embodiment one is that: multiple terminal bodies include a first terminal body 201, a second terminal body 202, and a third terminal body 203. The first terminal body 201, the second terminal body 202, and the third terminal body 203 are sequentially arranged at intervals and in parallel with each other on the insulation body 100.

Optionally, an extension section 11 facing away from the contact part 2 on the support part 1 has a first side 112 and a second side 113 which are arranged in parallel with each other, and an extension section 11 connected to the contact part 2 has a third side 114 and a fourth side 115 which are arranged opposite to each other.

Figure 3:
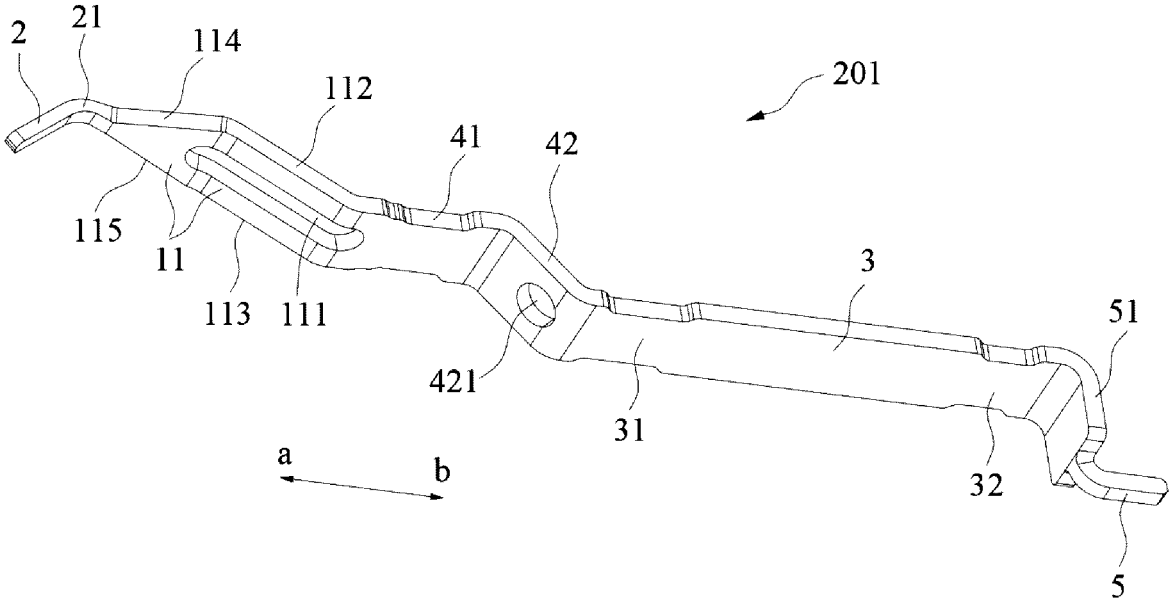
FIG. 3 is a structural diagram of a first terminal body provided by embodiment two of the present disclosure.

Optionally, referring to FIG. 3, the second fixing part 42 of the first terminal body 201 is provided with a fixing hole 421 through the second fixing part 42, and the insulation body 100 is provided with a fixing part, and the second fixing part 42 is fixed to the insulation body 100 in a manner that the fixing part passes through the fixing hole 421. The first terminal body 201 is provided with a through hole 111 in the extension section 11 facing away from the contact part 2. In a direction towards the contact part 2, the third side 114 and the fourth side 115 on the first terminal body 201 are arranged obliquely towards an axial direction of the extension section 11 separately.

Figure 4:
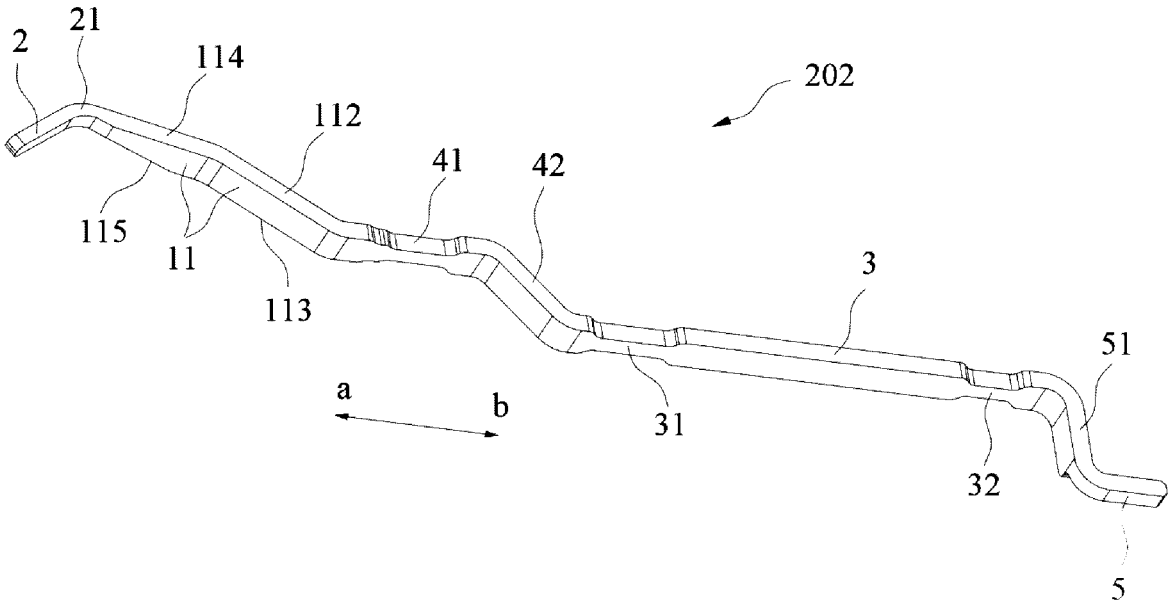
FIG. 4 is a structural diagram of a second terminal body provided by embodiment two of the present disclosure.

Optionally, referring to FIG. 4, a third side 114 on the second terminal body 202 is arranged on an extension surface of the first side 112, and the fourth side 115 is arranged obliquely towards the third side 114 in a direction towards the contact part 2.

Figure 5:
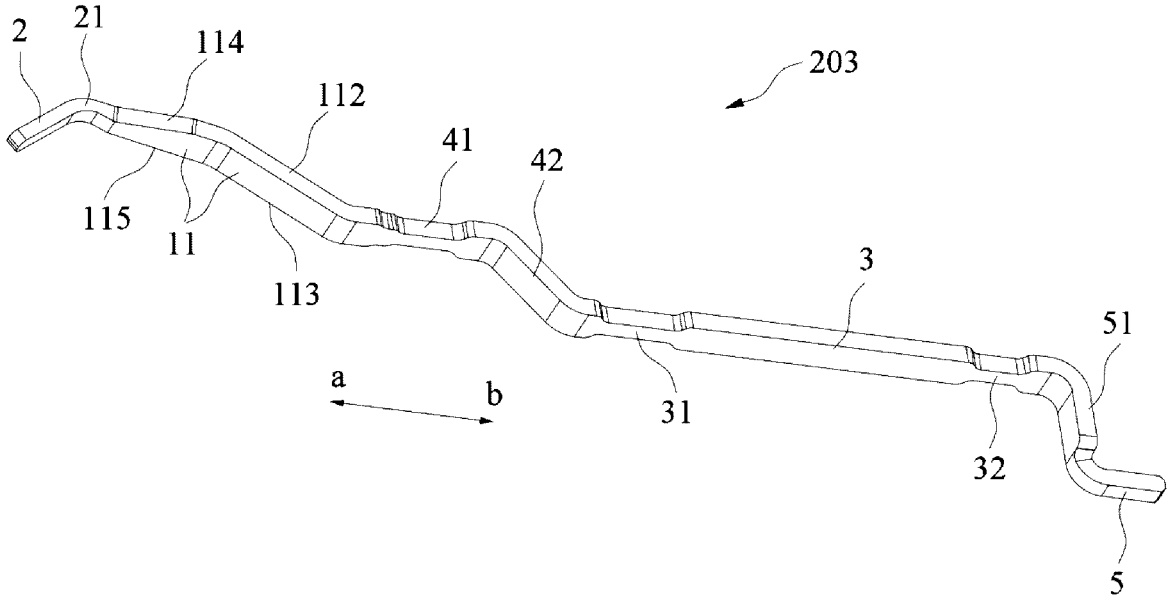
FIG. 5 is a structural diagram of a third terminal body provided by embodiment two of the present disclosure.

Optionally, referring to FIG. 5, the fourth side 115 on the third terminal body 203 is arranged on an extension surface of the second side 113, and the third side 114 is arranged obliquely towards the fourth side 115 in the direction towards the contact part 2.

Figure 6:
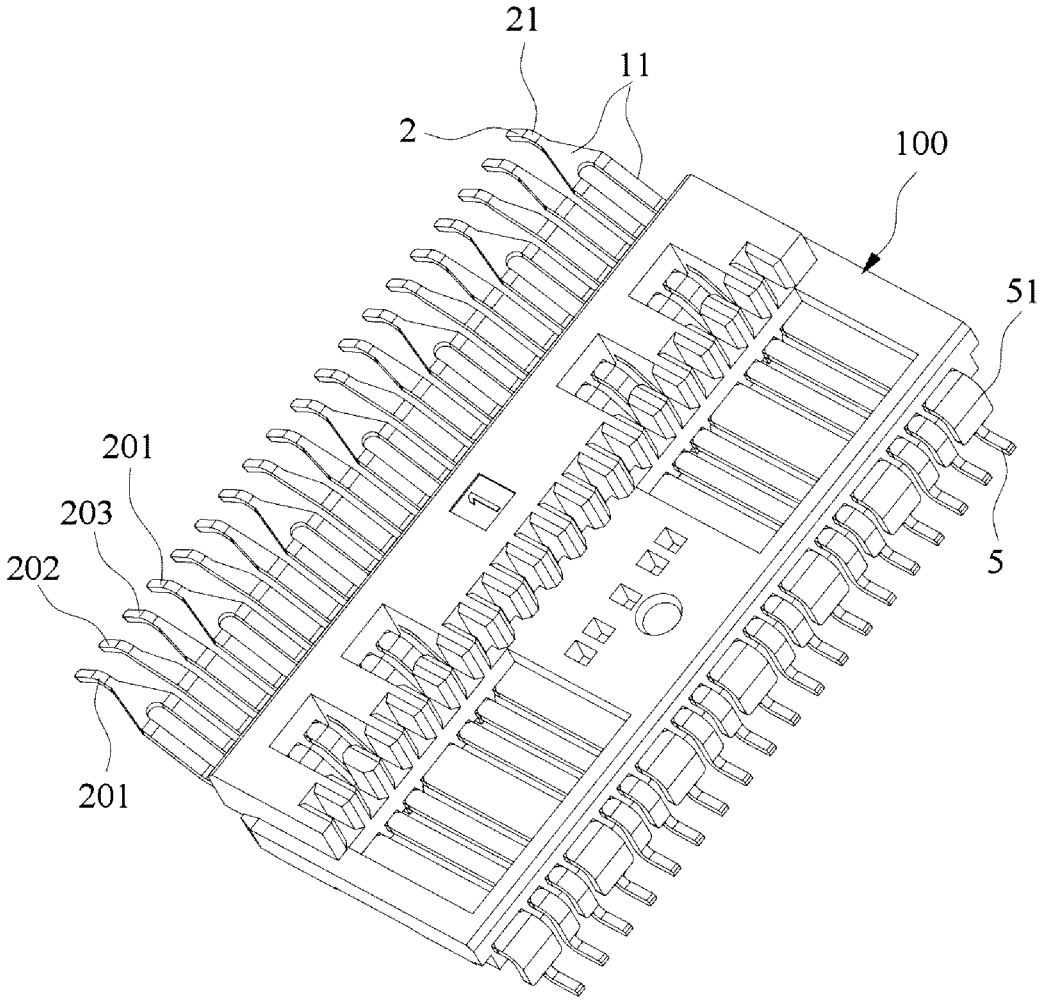
FIG. 6 is a structural diagram of a connector terminal provided by embodiment two of the present disclosure.

Referring to FIG. 6, multiple first terminal bodies 201, multiple second terminal bodies 202 and multiple third terminal bodies 203 are provided in this embodiment. Optionally, the multiple first terminal bodies 201 are arranged at intervals and in parallel with each other on the insulation body 100. One second terminal body 202 and one third terminal body 203 are arranged between each two adjacent ones of the multiple first terminal bodies 201, and the fourth side 115 of the second terminal body 202 is arranged opposite to the third side 114 of the third terminal body 203.

In the elastic arm structure and the connector terminal including the elastic arm structure of the present disclosure, the elastic arm structure is arranged in the contact part of the operation end of the support part by the supporting of the support part. Optionally, the bending structure is formed by sequentially connecting multiple extension sections, and an included angle of each of the extension directions of each of the multiple extension sections and the length direction of the terminal body is configured differently. That is, from the connection end to the operation end, the included angle is gradually reduced, thereby reducing a drop between the operation end and the connection end on the support part, enhancing a support force to the contact part, so that the elastic arm structure cannot be easily damaged during the insertion and extraction process, and the normal use of the connector terminal in the connector is ensured.

What is claimed is:

1. A connector terminal, comprising: an insulation body and a plurality of terminal bodies, wherein each of the plurality of terminal bodies comprises an elastic arm structure;

wherein the elastic arm structure is configured to be arranged at one end of one of the plurality of terminal bodies and comprises a support part and a contact part, the support part is a bending structure formed by sequentially connecting a plurality of extension sections, a first end of the support part is an operation end, a second end of the support part is a connection end, and from the connection end to the operation end, an included angle between a first direction and each of extension directions of the plurality of extension sections is gradually reduced, and the first direction is parallel to a length direction of the one of the plurality of terminal bodies, and the contact part is arranged at the operation end and is bent towards an inner side of the bending structure;

wherein the elastic arm structure protrudes out of a first end of the insulation body, and each of the plurality of terminal bodies further comprises:

a base part, wherein the base part is arranged on the insulation body and extends in the first direction; and a fixing part, wherein the fixing part is arranged on the insulation body, the fixing part comprises a first fixing part and a second fixing part which are arranged at an included angle, the first fixing part extends in the first direction, a first end of the first fixing part extends out of the insulation body and is connected to the connection end, a second end of the first fixing part is connected to a first end of the second fixing part, a bending direction of the first fixing part with respect to the support part is opposite to a bending direction of the contact part with respect to the support part, a second end of the second fixing part is connected to a first end of the base part, and a bending direction of the second fixing part with respect to the first fixing part is opposite to a bending direction of the support part with respect to the first fixing part.

2. The connector terminal of claim 1, wherein the second fixing part is provided with a fixing hole through the second fixing part.

3. The connector terminal of claim 1, wherein a first end of the base part connected to the second fixing part is provided with a first reinforcing part.

4. The connector terminal of claim 1, wherein one end of the contact part is bent to form a first arc-shaped section, the contact part is connected to the operation end by the first arc-shaped section, and an inner side of the first arc-shaped section is arranged towards the inner side of the bending structure.

5. The connector terminal of claim 1, wherein a cross-sectional area of one of the plurality of the extension sections connected to the contact part is gradually reduced in a direction towards the operation end.

6. The connector terminal of claim 1, wherein each two adjacent ones of the plurality of extension sections are connected by a second arc-shaped section, and an inner side of the second arc-shaped section is arranged towards the inner side of the bending structure.

7. The connector terminal of claim 1, further comprising: a welding part connected to a second end of the base part, wherein the welding part protrudes out of a second end of the insulation body.

8. The connector terminal of claim 7, wherein one end of the welding part connected to the base part is provided with a connection part, a bending direction of the connection part with respect to the base part is opposite to the bending direction of the second fixing part with respect to the base part, and the bending direction of the connection part with respect to the welding part is opposite to a bending direction of the base part with respect to the connection part.

9. The connector terminal of claim 8, wherein the second end of the base part connected to the connection part is provided with a second reinforcing part.

* * * * *